US005634179A

United States Patent [19]

Umeda et al.

[11] Patent Number: 5,634,179

[45] Date of Patent: May 27, 1997

[54] CHARGING DEVICE AND IMAGE FORMING APPARATUS CONTAINING THE CHARGING DEVICE

[75] Inventors: Yoshio Umeda, Kobe; Teruyuki Naka, Izumi; Toshiki Yamamura, Hirakata; Seiichi Suzuki, Katano; Junichi Nawama, Osaka, all of Japan

[73] Assignee: Matsushita Electric Industrial Co., Ltd., Kadoma, Japan

[21] Appl. No.: 302,068

[22] Filed: Sep. 7, 1994

[30] Foreign Application Priority Data

| | | | |
|---|---|---|---|
| Sep. 7, 1993 | [JP] | Japan | 5-221802 |
| Sep. 7, 1993 | [JP] | Japan | 5-221804 |
| Sep. 7, 1993 | [JP] | Japan | 5-221805 |
| May 10, 1994 | [JP] | Japan | 6-095360 |

[51] Int. Cl.[6] ..... G03G 15/02

[52] U.S. Cl. ..... 399/174

[58] Field of Search ..... 355/219, 221, 355/222; 361/212

[56] References Cited

U.S. PATENT DOCUMENTS

| | | | |
|---|---|---|---|
| 4,326,794 | 4/1982 | Nishimura | 355/221 X |
| 4,454,559 | 6/1984 | Shenoy | 355/219 X |
| 4,750,019 | 6/1988 | Kamitani | 355/274 |
| 4,851,960 | 7/1989 | Nakamura et al. | 355/222 X |
| 5,089,851 | 2/1992 | Tanaka et al. | 355/219 |
| 5,126,913 | 6/1992 | Araya et al. | 355/219 X |
| 5,146,281 | 9/1992 | Kisu | 355/219 |
| 5,177,534 | 1/1993 | Kisu et al. | 355/219 |

FOREIGN PATENT DOCUMENTS

| | | |
|---|---|---|
| 410 482 | 1/1991 | European Pat. Off. . |
| 574 208 | 12/1993 | European Pat. Off. . |
| 54-156548 | 10/1979 | Japan . |
| 56-147159 | 11/1981 | Japan . |
| 58-194061 | 11/1983 | Japan . |

*Primary Examiner*—Fred L. Braun

*Attorney, Agent, or Firm*—Fish & Richardson, P.C.

[57] ABSTRACT

A charging device for charging a moving photoconductor. The charging device includes a charging member, an electric power supply for applying a voltage to the charging member, and a light exposing device, such as a LED for exposing surfaces of the charging member and the photoconductor in a closing region where the surfaces of the charging member and the photoconductor move closer to each other. The charging member is a blade having a transparent layer for guiding a light beam from the LED to the closing region and a shading layer for shading the light beam to a contacting region and a separating region. The contacting region is where the surfaces of the charging member and the photoconductor contact, and the separating region is where the surfaces of the charging member and the photoconductor gradually separate from each other. The LED is disposed in the vicinity of an end of the transparent layer opposite to the other end in the closing region in a section parallel to the moving direction of the photoconductor.

35 Claims, 9 Drawing Sheets

CHARGING DEVICE AND IMAGE FORMING APPARATUS CONTAINING THE CHARGING DEVICE

FIELD OF THE INVENTION

This invention relates to a charging device for electrostatically charging objects which are to be charged, and further relates to an image forming apparatus containing the charging device. The charging device is especially useful in an electrophotographic image forming apparatus.

BACKGROUND OF THE INVENTION

The electrophotographic image forming apparatus has, in general, been used for a document copier, a laser beam printer and so on. In such a conventional electrophotographic apparatus, a corona discharger has been broadly used for electrostatically charging a photoconductor (photosensitive element) which is an object to be charged. The corona discharger comprises a fine wire and a shielding electrode. A high voltage, such as 4 to 5 kV, is applied to the wire. Thus, the photoconductor is electrostatically charged evenly by discharge between the wire and the photoconductor. Furthermore, another corona discharger, which has a grid disposed between the wire and the photoconductor, is used for making the charge distribution of the photoconductor more even. Such a corona discharger is called Scorotron and widely used now.

The Scorotron, however, needs an electric power supply which can supply a high voltage of several kilovolts for making the discharge stable. Furthermore, a lot of ozone, which is injurious to the human body, is produced during the discharge. Therefore, an ozone treatment apparatus is necessary. Or, the photoconductor is deteriorated by ozone.

On the contrary, another method or apparatus has been proposed for reducing ozone at a minimum. In the method or apparatus, a conductive charging member contacts the surface of the photoconductor. The discharge occurs between the charging member and the surface of the photoconductor, so that the photoconductor is directly charged. The discharge is kept at a minimum which is necessary for electrostatically charging the photoconductor. As a result, the amount of ozone, which is produced during the discharge, can be reduced.

There are many examples of the apparatus for directly charging the photoconductor by contacting the surface thereof. Publication gazette of Japanese Examined Patent Application Sho 62-11343 discloses the use of a conductive elastic roller as a charging member. Publication gazette of Japanese Unexamined Patent Application Sho 56- 147159 discloses a method for using a fur brush (fiber brush). From the point of view of producing an electric field for generating the discharge, Publication gazette of Japanese Unexamined Patent Application Sho 58-194061 discloses the method for applying DC voltage to the charging member. U.S. Pat. No. 4,851,960 discloses the method for applying superposed DC voltage and AC voltage to the charging member.

In the method of using the fur brush, the contact condition of the fur brush and the surface of the photoconductor is unstable, so that the charge distribution on the surface of the photoconductor will be uneven. Furthermore, the fur of the brush will be deteriorated or will lie flat over time passes, so that charging will become unstable.

On the other hand, in the method of using the conductive elastic roller, the roller contacts the photoconductor more stably and evenly than in the case of using the fur brush.

Thus, the deterioration of the roller becomes smaller. However, in the method of using the conductive elastic roller, unevenness of the charge distribution will occur owing to surface roughness or unevenness in resistance of the roller. Comparing the case of applying DC voltage to the roller to the case of applying the superposed DC and AC voltages to the roller, charge distribution in the latter case is flatter than that in the former case, and the tolerance of the charge in the latter case is larger than that in the former case. However, when the AC voltage is applied, vibration electric field is generated between the conductive elastic roller and the photoconductor, so that noise called charge noise occurs. Such a noise is governed by the frequency of the AC voltage which is applied to the conductive elastic roller. The noise becomes a problem when the frequency of the noise is in a region of audible frequency (20 to 2000 Hz, especially 200 to 2000 Hz). For preventing the audible noise, it is necessary to make the frequency of the AC voltage smaller than 200Hz or alternatively larger than 2000 Hz. When the frequency of the AC voltage is made larger than 2000 Hz, the voltage is largely attenuated in the charging member, and it becomes very ineffective. When the frequency of the AC voltage is made smaller than 200 Hz, frequent unevenness of the charge occurs in a circumferential direction of the photoconductor.

When the frequency of the AC voltage is designated by "f" (Hz) and the moving speed (called process speed) of the photoconductor is designated by "$V_p$" (mm/sec), the frequent unevenness of the charge with a pitch of $V_p/f$ mm occurs in the circumferential direction of the photoconductor. This phenomenon occurs for the following reasons. The above-mentioned vibration electric field is gradually attenuated in a separating region of the charging member and the photoconductor, where their surfaces are gradually getting separate from each other, and surface potential of the photoconductor will be converged to the DC voltage which is superposed on the AC voltage. At this time, the frequency of the applied AC voltage is finite, so that transition and reverse transition of the electric charge between the charging member and the photoconductor may not simultaneously occur when the charging is completed (namely when the surface potential of the photoconductor is converged). Accordingly, the charging will be stopped when the final transition or reverse transition occurs responding to a phase of the frequency of the AC voltage at that time. When charging is completed, the phase of the frequency of the AC voltage in the axial direction of the photoconductor is constant but varies in response to the position in the circumferential direction of the photoconductor. Thus, a striped pattern of unevenness in the charge distribution, which is synchronized with the frequency of the AC voltage and parallel to the axis of the photoconductor, occurs. The pitch of the stripes is $V_p/f$ mm. When the pitch of the stripes is wider than the minimum pitch (resolution) at which a developing device of the image forming apparatus can develop, a developed picture image will be inferior or defective. For preventing an inferior or defective image, it is necessary to make the frequency "f" of the AC voltage larger. For example, in an image forming apparatus having a printing speed of four sheets of Japanese JIS standard paper size of A4 in one minute (processing speed is 25 m/sec), it is necessary to make the frequency of the AC voltage above 100 Hz.

Similarly, in an image forming apparatus having a printing speed of 30 sheets in one minute (processing speed is 190 mm/sec), the frequency of the AC voltage is above 750 Hz. In this case, the above-mentioned problem of the charging noise occurs. In other word, an upper limit of the processing speed of the image forming apparatus is limited by the frequency region of the AC voltage In which the charging noise does not occur. As a result, it is difficult to make the printing speed much faster by using the method of superposing the DC voltage on the AC voltage. Furthermore, an AC electric power supply is expensive and has a large volume. Thus, it makes the size of the image forming apparatus larger and the cost of the apparatus higher.

On the contrary, when only DC voltage is applied to the conductive elastic roller, the printing speed of the image forming apparatus can be made faster, the size of the apparatus can be made smaller and the cost of the apparatus can be made lower. However, it has the above-mentioned disadvantage that the charge distribution becomes uneven.

SUMMARY OF THE INVENTION

An objective of the invention is to provide an charging device which can be driven by a lower voltage, can evenly charge an object to be charged, and can be reduced in amount of ozone produced during the charging operation.

Another objective of the invention is to provide an charging device which can respond to a high speed process and has a simple and small configuration.

Still another objective of the invention is to provide an image forming apparatus having the charging device.

A charging device for charging a moving object of the invention comprises:

a charging member which contacts the object in a contacting region and charges the object in a separating region disposed in a downstream part from the contacting region in the moving direction of the object where surfaces of the charging member and the object move away from each other;

an electric power supply for applying a voltage to the charging member; and a charging restriction means for restricting the charging of the object in a closing region disposed in an upstream part from the contacting region where surfaces of the charging member and the object move closer to each other.

In the charging device configured above, it is preferable that the electric power supply supplies a DC voltage to the charging member.

In the charging device configured above, it is more preferable that the charging member is a roller having a core and a conductive elastic layer.

In the charging device configured above, it is still more preferable that the conductive elastic layer is made of rubber including conductive particles.

Alternatively, in the charging device configured above, it is preferable that the charging member is a blade having elasticity and semi-conductivity.

In the charging device configured above, it is still more preferable that the blade is made of semi-conductive rubber including conductive particles.

Alternatively, in the charging device configured above, it is further preferable that the blade is made of a semi-conductive polymer sheet.

In the charging device configured above, it is also preferable that the rubber is selected from urethane, EPDM (ethylene propylene diene monomer) and silicon.

In the charging device configured above, it is preferable that the conductive particles are carbon or inorganic metallic salt.

In the charging device configured above, it is furthermore preferable that volume resistivity of the conductive elastic layer or the blade is from $10^5$ to $10^{12}$ Ωcm.

Alternatively, in the charging device configured above, it is preferable that the charging member is a block made of semi-conductive rubber.

In the charging device configured above, it is further preferable that both ends of the block in the moving direction of the object are chamfered.

In the charging device configured above, it is furthermore preferable that the block is made of fluoro rubber or silicon rubber.

In the charging device configured above, it is preferable that fluororesin is coated on a surface of the block contacting the object.

In the charging device configured above, it is also preferable that the charging restriction means is a light exposing device for exposing at least the surfaces of the charging member and the object in the closing region.

In the charging device configured above, it is furthermore preferable that the light exposing device is disposed In the vicinity of the charging member and the object in the closing region.

Alternatively, In the charging device configured above, it is furthermore preferable that the charging member is a blade comprising a transparent layer for guiding a light beam from the light exposing device to the closing region and a shading layer for shading the light beam to the contacting region and the separating region; and the light exposing device is disposed in the vicinity of an end of the transparent layer opposite to the other end in the closing region in a section parallel to the moving direction of the object.

Alternatively, in the charging device configured above, it is furthermore preferable that the charging restriction means is a light exposing device for exposing a surface of the object in upstream part from the closing region; and quantity of the light emitted from the light exposing device is controlled in a manner so that a potential difference between surface potential of the object when it is exposed and surface potential of the surface when it is not exposed is more than 30 V.

Alternatively, in the charging device configured above, it is preferable that the charging restriction means is a light exposing device for exposing a surface of the object in upstream part from the closing region; and quantity of the light emitted from the light exposing device is controlled in a manner so that a difference between a current flowing into the charging member when the surface of the object is exposed and a current flowing into the charging member when the surface of the object is not exposed is more than 5 μA.

In the charging device configured above, it is preferable that the light exposing device is one selected from a light emitting diode, a cold cathode ray tube, a glow lamp, a halogen lamp and a semi-conductor laser.

In the charging device configured above, it is preferable that the object to be charged is a photoconductive material selected from selenium, amorphous silicon and organic photoconductive material.

Alternatively, in the charging device configured above, it is preferable that the charging restriction means is a conductive member provided in the closing region, to which a predetermined voltage is applied or which is grounded.

In the charging device configured above, it is also preferable that the conductive member is a blade or at least one wire.

In the charging device configured above, it is furthermore preferable that a resistive layer is formed on at least a part of a surface of the conductive member facing to the object.

In the charging device configured above, it is still furthermore preferable that volume resistivity of the resistive layer is from $10^5$ to $10^{12}$ Ωcm.

Another charging device for charging a moving object of the invention comprises:

a charging member contacting the object in a contacting region and charging the object in a separating region disposed in a downstream part from the contacting region in the moving direction of the object where surfaces of the charging member and the object move away from each other;

an electric power supply for applying a voltage to the charging member; and a discharging restriction means for restricting the discharging between the charging member and the object in a closing region disposed in an upstream part from the contacting region where surfaces of the charging member and the object move closer to each other.

In the charging device configured above, it is preferable that the discharging restriction means is an insulation layer formed on a part of a surface of the charging member facing the object in the closing region.

In the charging device configured above, it is preferable that the charging member is a blade or a block and the insulation layer is provided in the vicinity of an end of the blade contacting the object.

In the charging device configured above, it is furthermore preferable that volume resistivity of the charging member is in from $10^5$ to $10^{12}$ Ωcm; and volume resistivity of the insulation layer is from $10^{10}$ to $10^{15}$ Ωcm.

In the charging device configured above, it is also preferable that a boundary between the charging member and the insulation layer is in the contacting region.

In the charging device configured above, it is furthermore preferable that the discharging restriction means is insulation particles provided in the closing region.

In the charging device configured above, it is still furthermore preferable that the insulation particle is a magnetic toner having a spherical shape and the diameter thereof is from 8 to 15 μm.

An image forming apparatus of the invention comprises:

an object to be charged and moved in a predetermined moving direction;

a charging member which contacts the object in a contacting region and charges the object in a separating region disposed in a downstream part from the contacting region in the moving direction of the object where surfaces of the charging member and the object move away from each other;

an electric power supply for applying a voltage to the charging member; and a charging restriction means for restricting the charging of the object in a closing region disposed in an upstream part from the contacting region where surfaces of the charging member and the object move closer to each other.

In the image forming apparatus configured above, it is preferable that the charging restriction means is a light exposing device for exposing at least the surfaces of the charging member and the object in the closing region.

In the image forming apparatus configured above, it is preferable that the charging restriction means is a light exposing device for exposing a surface of the object in an upstream part from the closing region; and quantity of the light emitted from the light exposing device is controlled in a manner so that a potential difference between surface potential of the object when it is exposed and surface potential of the object when it is not exposed is more than 30 V.

Alternatively, in the image forming apparatus configured above, it is preferable that the charging restriction means is a light exposing device for exposing a surface of the object in upstream part from the closing region; and quantity of the light emitted from the light exposing device is controlled in a manner so that a difference between a current flowing into the charging member when the surface of the object is exposed and a current flowing into the charging member when the surface of the object is not exposed is more than 5 μA.

In the image forming apparatus configured above, it is also preferable that the charging restriction means is a conductive member provided in the closing region, to which a predetermined voltage is applied or which is grounded.

Another image forming apparatus of the invention comprises:

an object to be charged and moved in a predetermined moving direction;

a charging member which contacts the object in a contacting region and charges the object in a separating region disposed in a downstream part from the contacting region in the moving direction of the object where surfaces of the charging member and the object move away from each other;

an electric power supply for applying a voltage to the charging member; and a discharging restriction means for restricting the discharging between the charging member and the object in a closing region disposed in an upstream part from the contacting region where surfaces of the charging member and the object move closer to each other.

As described above, the charging device or the image forming apparatus of the invention directly discharges between the charging member and the object to be charged for charging the object. Thus, the amount of ozone produced during the charging operation becomes very small and the voltage applied to the charging member can be made lower. Furthermore, the charging device does not charge the object in the upstream part from the contacting point of the charging member and the object, but charges the object in the downstream part from the contacting point (or the separating region). Thus, the surface of the object can be charged evenly, since the discharge starts in the minute gap part. In addition, DC voltage is applied to the charging member and an AC electric power supply is not used, so that the charging speed can be made faster and the apparatus can be down-sized.

BRIEF DESCRIPTION OF THE DRAWINGS

FIG. 14(*b*) is a partially enlarged sectional side view showing another detailed configuration of the charging device of FIG. 13.

DETAILED DESCRIPTION OF THE INVENTION

First Embodiment

Figure 1:
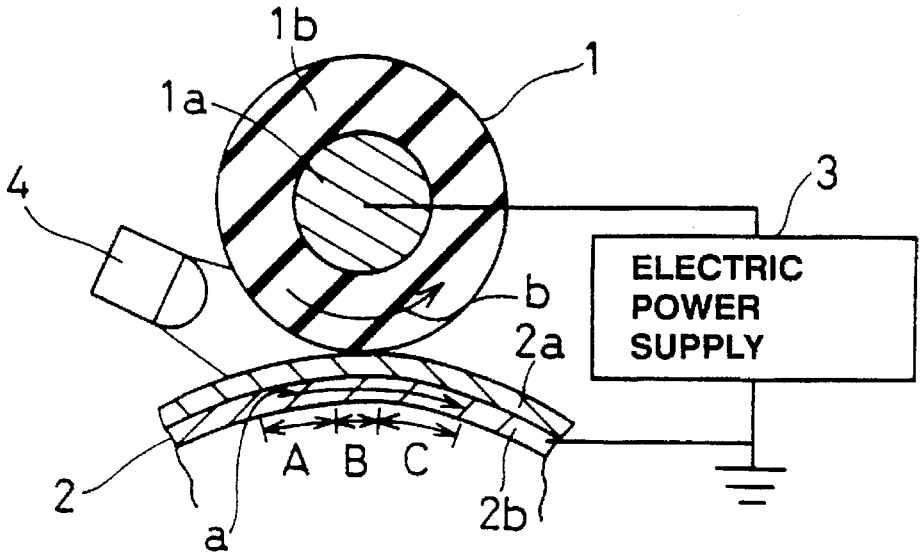
FIG. 1 is a sectional side view showing a configuration of a first preferred embodiment of a charging device of the invention.
Figure 2:
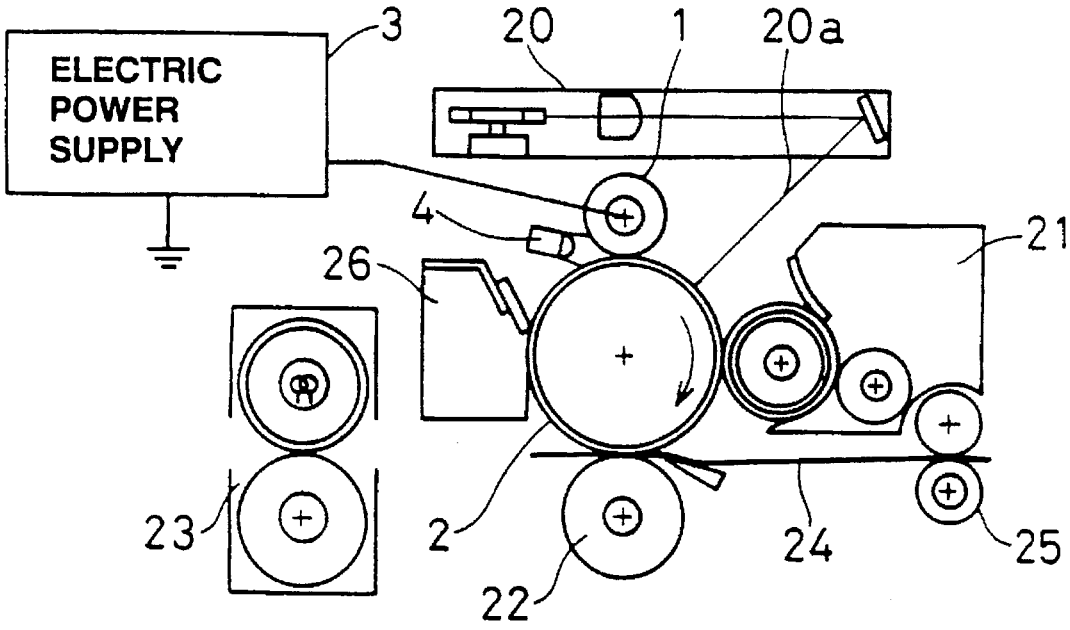
FIG. 2 is a sectional side view showing a configuration of an image forming apparatus having the charging device of FIG. 1.

A first preferred embodiment of a charging device or an image forming apparatus of the invention is described referring to FIGS. 1 and 2. FIG. 1 shows a side view of the charging device, and FIG. 2 shows a side view of the Image forming apparatus having the charging device shown in FIG. 1.

As shown in FIG. 1, a charging roller 1 serves as a charging member and it has semi-conductivity. The charging roller 1 is rotatively pivoted and it contacts a surface of a drum-shaped photoconductor 2 with a predetermined pressure. The photoconductor 2 is an object to be electrostatically charged. The photoconductor 2 has a photoconductive layer 2*a* which is formed on a conductive base member 2*b*. The Photoconductive layer 2*a* is made of a photoconductive material such as an organic photoconductive material, amorphous silicon or selenium. The photoconductor 2 is rotated in a direction shown by arrow "a" with a predetermined rotation speed. The charging roller 1 is rotated in a direction shown by arrow "b" following to the rotation of the photoconductor 2. A DC voltage is applied to the charging roller 1 by an electric power supply 3.

Hereupon, the surface of the photoconductor 2 in the vicinity (before and behind) of a contacting point of the charging roller 1 and the photoconductor 2 is divided into three regions.

(1) A first region designated by "A" is a closing region where the surfaces of the charging roller 1 and the photoconductor 2 gradually move closer to each other.

(2) A second region designated by "B" is a contacting region where the surfaces of the charging roller 1 and the photoconductor 2 contact.

(3) A third region designated by "C" is a separating region where the surfaces of the charging roller 1 and the photoconductor 2 gradually separate from each other.

These three regions will be applied to following other embodiments.

A light emitted diode (LED) 4, which serves as a light exposing device, is disposed in the vicinity of the charging roller 1 and the photoconductor 2 for exposing the surfaces of the photoconductor 2 and the charging roller 1 in the closing region A.

The charging roller 1 comprises a core 1*a* made of metal and a conductive elastic layer 1*b* formed on the core 1*a*. The conductive elastic layer 1*b* is made of rubber such as urethane, EPDM (ethylene propylene diene monomer) or silicon which includes dispersed conductive particles such as carbon. Alternatively, the conductive elastic layer 1*b* is made of the above-mentioned rubber to which conductive material such as inorganic metallic salt is added. Volume resistivity of the conductive elastic layer 1*b* is preferable to be in a range of $10^5$ to $10^{12}$ Ω cm. If the resistance of the conductive elastic layer 1*b* is too small, charge supplying performance for supplying electric charge from the core 1*a* to the surface of the conductive elastic layer 1*b* becomes too high during the charging operation. Hereupon, in view of the presence of defects such as pin holes in the photoconductive layer 2*a* of the photoconductor 2, the resistance at the pin holes may be much smaller than that at another point of the photoconductive layer 2*a*. When the resistance of the conductive elastic layer 1*b* is too small, an electric current flown from the core 1*a* concentrates at the pin hole parts. Thus, the charge distribution at not only the pin hole parts but also the other parts of the photoconductive layer 2*a* will cause inferior or defective charging. On the contrary, when the resistance of the conductive elastic layer 1*b* is too high, the charge supplying performance from the core 1*a* to the conductive elastic layer 1*b* during the charging becomes lower, so that the charging operation can not be continued.

The charge supplying performance is a generic term encompassing the mobility of charged particles in the conductive elastic layer 1*b* and easiness of discharging the electric charge on the surface of the conductive elastic layer 1*b*. According to the material of the rubber which forms the conductive elastic layer 1*b*, it is necessary to consider the influence of temperature and/or humidity. The above-mentioned range of the volume resistivity of the conductive elastic layer 1*b* takes into account the influence of temperature and/or humidity.

Hardness of the rubber of the conductive elastic layer 1*b* is desirably lower, and it is necessary to have a predetermined hardness which is sufficient so as not to make any gap between the charging roller 1 and the photoconductor 2.

Since the conductive elastic layer 1*b* is formed by rubber, plasticizer or low molecular rubber oozes out to the surface of the conductive elastic layer 1*b* from inside thereof according to the hardness or kind of the material. Such an oozed plasticizer or low molecular rubber will adhere to the surface of the photoconductor 2 and will badly influence it, especially the photoconductive characteristics of the photoconductive layer 2*a*. Thus, a surface layer can be provided on the conductive elastic layer 1*b* for preventing the oozing of the plasticizer and so on. Such a surface layer is formed by a resin such as nylon or urethane. The resistance of the surface layer may be adjusted by dispersing the conductive particles therein.

A description of trial production of the image forming apparatus is described. The core 1*a* of the charging roller 1 was made of stainless steel having a diameter of 6 mm. The conductive elastic layer 1*b* was made of urethane rubber having a thickness of 3 mm. The volume resistivity of the conductive elastic layer 1*b* was $10^6$ Ω cm and the surface hardness was 50 degree (by Japanese JIS standard A-hardness: JIS-K-7215). A DC voltage ($V_o$) of 1100 V was applied to the charging roller by the electric power supply 3. The conductive base member 2*b* of the photoconductor 2 was made of aluminum having a diameter of 30 mm, and the photoconductive layer 2*a* was formed by the organic photoconductor having a thickness of 20 μm. The photoconductor 2 was rotated at a peripheral speed 25 mm/sec in the direction shown by the arrow in FIG. 2. A magnetic one-component negatively charged toner (colored particles) having an average particle diameter of about 8 μm was used in developing device 21.

Operation of the image forming apparatus is described. The surface of the photoconductor 2 is charged at a predetermined negative voltage ($V_o$) by the charging roller 1 which is applied the predetermined voltage by the electric power supply 3. After that, the surface of the photoconductor 2 is selectively exposed by laser beam 20*a* from a laser scanning unit 20. As a result, an electrostatic latent image is formed on the photoconductor 2, where the potential of the exposed part is made lower than that of the other part (absolute value of the potential is reduced). The negatively charged toner is adhered to the photoconductor 2 corresponding to a pattern of the electrostatic latent image in the developing device 21. As a developing device 21, a negative developing type developing device was used. In the negative developing type developing device, the toner is adhered on the exposed part by the laser beam where the potential is lower than that of the other part. The developing bias voltage $V_B$ was −350 V. If the polarity of the toner is reversed, it is possible to use a positive developing type developer where the toner is adhered to a high potential part.

A toner image formed on the photoconductor 2 by the developing device 21 is transferred to a paper sheet 24 by a transfer roller 22. The paper sheet 24 is supplied by resist rollers 25 at a predetermined timing having a predetermined relation at a transferring point between a front end of the paper sheet 24 and a top of the toner image on the photoconductor 2. The paper sheet 24, to which the toner image was transferred, departs from the photoconductor 2, and carried to a fusing device 23. The toner is heated and pressed on the paper sheet 24 by the fusing device 23, and the toner is firmly fixed on the paper sheet 24. Thus, a picture image is formed on the paper sheet 24.

On the other hand, the toner remaining on the surface of the photoconductor 2 is cleaned by a cleaner 26. The cleaned photoconductor 2 is charged by the charging device (charging roller 1) again. By repeating the above-mentioned operation, picture images are continuously printed.

Some picture images were formed by the above-mentioned image forming apparatus under several conditions without exposure by the LED 4. Namely, the picture images were formed by substantially the same method as a conventional image forming apparatus. Performance of the charging device was estimated by quality of the picture images formed by the image forming apparatus and the surface potential of the photoconductor 2 when corresponding picture images were formed. The surface potential of the photoconductor 2 was measured by a potentiometer (TREK Co. Ltd., MODEL 344). A probe of the potentiometer is disposed on a developing part of the developing device 21 where some parts were removed.

First, under a normal temperature and a normal humidity environment (room temperature 20 degrees Celsius, humidity 50%), a good quality picture image was printed and the surface potential $V_o$ of the photoconductor 2 was −550 V.

Second, under a higher temperature and a higher humidity environment (room temperature 33 degrees Celsius, humidity 80%), a good quality picture image was printed and the surface potential $V_o$ of the photoconductor 2 was −580 V.

Third, under a lower temperature and a lower humidity environment (room temperature 7 degrees Celsius, humidity 20%), fog of small spots (diameter thereof was 50 to 500 μm) were observed on a white ground, and white holes of small spots (diameter thereof was 50 to 500 μm) were also observed on a black ground in the printed picture image. The surface potential $V_o$ of the photoconductor 2 was −520 V.

The values of the surface potential $V_o$ under these three environments depended on the resolution of the potentiometer. Namely, the potentiometer measured an average of the surface potential in an area of about 2 mm square. Accordingly, it was impossible to measure the unevenness of the charge distribution which would be the cause of fog or white holes observed in the picture image printed under the lower temperature and the lower humidity environment. Therefore, minute unevenness of the charge distribution was Indirectly estimated by measuring how an amount of fog and the white holes were changed responding to the change of the biasing voltage $V_B$ of the developing device 21. At first, the absolute value of the biasing voltage $V_B$ was gradually increased. When the basing voltage $V_B$ approached to the voltage $V_o$, both the fog and the white holes were reduced. When the absolute value $V_b$ of the biasing voltage was reduced, both the fog and the white holes were increased. If the potential of the spotted unevenness part of the charge distribution $V_o$ is lower, the fog would be increased when the biasing voltage $V_B$ was made higher in the negative development. From such a result of an experiment, the following point was cleared with consideration of doctrine of the negative development and the charge distribution of the toner in the developing device using the one-component magnetic toner. The fogs may be caused by the development of the positively charged toner, which has a reverse polarity than that of the toner normally used, at a position superfluously charged than the position charged in the average voltage $V_o$. Such a phenomenon is verified by another method. When the polarity of the toner adhered on the photoconductor 2 is measured by Faraday-Cage method, reversely charged toner was adhered.

The reason why the superfluous charge occurs is analyzed. Theoretically, an electric discharge following Paschen's law occurs in a minute air gap in the closing region between the charging roller 1 and the photoconductor 2. Thus, the photoconductive layer 2*a* of the photoconductor 2 is charged. When the voltage in the air gap between the charging roller 1 and the photoconductive layer 2*a* becomes lower than a predetermined voltage defined by Paschen's law by the charge on the surface of the photoconductive layer 2*a* of the photoconductor 2, the discharge stops and the charging operation is completed. At this time, the potential of the photoconductive layer 2*a* is theoretically defined by the thickness and dielectric constant of the photoconductive layer 2*a*. The theoretically calculated value of the potential is substantially coincident with the actually measured value $V_o$. Therefore, the charging operation follows to Paschen's law in view of the average potential.

To confirm that a superfluous charge occurs, an experiment was executed using the charging roller and a transparent electrode. The discharging condition was observed by changing the air gaps between the charging roller and the transparent electrode. A glimmering but even light emission was observed during the discharging operation when the air gap was smaller than 50 μm. On the other hand, uneven light emission was observed when the air gap was larger than 50 μm. Namely, it is difficult to generate even discharge in the region where the air gap is larger than 50 μm, and an abnormal discharge will occur at a point where the electric field is concentrated by the unevenness of the surface or unevenness of the resistance of the charging roller. It is considered that the charge was superfluously moved by the abnormal discharging.

In spite of the difference between the photoconductive layer and the transparent electrode, it can be considered that an abnormal discharge occurs in an initial part of the closing region of the charging roller 1 and the photoconductor 2 where the air gap is larger than 50 μm based on the above-mentioned experiment result. Thus, the photoconductive layer 2*a* is superfluously charged. As a result, defects in the picture image such as the fogs or white holes will be caused.

From the above-mentioned consideration, the inventors proposed to restrict the charging of the photoconductor 2 in the closing region where the abnormal discharging may occur, but to charge the photoconductor 2 in the separating region. In the separating region, the charging operation starts at a position where the air gap is very small, so that the photoconductive layer 2*a* is evenly charged. After that, since the air gap becomes larger and the photoconductive layer 2*a* is continuously charged, the electric field in the air gap is quickly decreased. If the charging operation can be completed before the air gap reaches a length which will cause abnormal discharge, the charge distribution of the photoconductive layer 2*a* can be made even. Based on this consideration, the LED 4 for exposing the surfaces of the charging roller 1 and the photoconductive layer 2*a* of the photoconductor 2 in the closing region is provided in a manner so that the charging of the photoconductive layer 2*a* in the closing region is to be restricted. A picture image was formed or printed under the above-mentioned lower temperature and lower humidity environment with exposing the closing region by the LED 4. As the LED 4, a light emitting diode having a peak wavelength of 780 nm was used corresponding to sensitivity of wavelength of the photoconductive layer 2*a*. As a result, a good quality picture image could be printed without the fogs or white holes which were observed when the LED 4 was off.

When the surface of the photoconductive layer 2*a* in the closing region is exposed, pair carriers of positive charge and negative charge are generated in the photoconductive layer 2*a*. Hereupon, if the discharge occurs between the charging roller 1 and the photoconductor 2 in the closing region, the surface of the photoconductive layer 2*a* is charged. The electrostatic charge on the photoconductive layer 2*a* generates an electric field, so that the pair carriers are departed and moved by the electric field. The positive carrier cancels the charge on the surface of the photoconductive layer 2*a*. Thus, the electrostatic charge on the surface of the photoconductive layer 2*a* in the closing region will disappear, even though the discharge including the abnormal discharge occurs in the closing region. Parts of the surfaces of the charging roller and the photoconductor 2 which are positioned at first in the closing region will move to the separating region through the contacting region. Since the light beam from the LED 4 can not reach the separating region, the pair carriers may not be generated in the photoconductive layer 2*a* in the separating region. As mentioned above, abnormal discharge may not occur in the separating region. Thus, the surface of the photoconductive layer 2*a* in the separating region can be charged evenly.

The abnormal discharge should not be generated between the surfaces of the charging roller and the photoconductive layer 2*a* of the photoconductor 2 in the separating region. Thus, the surface of the charging roller 1 must have a condition for restricting the abnormal discharge in the separating region. The inventors confirmed the condition by an experiment. When the surface roughness of the charging roller 1 was smaller that 20 μm ($R_{max}$, JIS-B-0601), the abnormal discharge could not occur.

When the cleaning of the surface of the photoconductive layer 2*a* of the photoconductor 2 is completed and the cleaned surface returns to the charging process again, the developer does not remain on the surface of the photoconductive layer 2*a*. However, the unevenness of the charge distribution occurs on the photoconductive layer 2*a* owing to an optical residual image by exposure of the laser scanning unit 20 and an electrical residual image by electric field of the transfer rollers 22. Conventionally, an eraser lamp (not shown in the figure) was provided at a position in a downstream part of the cleaner and in an upstream part of the charging device. Thus, the optical residual image on the photoconductive layer 2*a* was conventionally erased by exposing the surface of the photoconductive layer 2*a* entirely by the eraser lamp. On the other hand, the electric residual image can not be erased by the conventional erasing lamp, since the electrical residual image was charged in the reverse polarity to the polarity of the charge on the surface of the photoconductive layer (in this embodiment, the polarity of the charge is plus).

The charging operation of the charging device of the invention charges the surface of the photoconductive layer 2*a* and erases the electrostatic charge on the photoconductive layer 2*a* by the pair carriers in the closing region at the same time, so that not only the optical residual image but also the electrical residual images can be erased.

By the above-mentioned charging device of image forming apparatus of the invention, not only can the problems of fog on the white ground and white holes on the black ground under the lower temperature and humidity environment be solved, but also the optical and electrical residual images on the photoconductive layer 2*a* can be erased.

In the above-mentioned first embodiment, the charging roller 1 is followingly driven by the photoconductor 2. However, the charging roller 1 can be independently driven with the same speed as the speed of the photoconductor 2. In the latter case, wearing flaws, which can easily be generated when there is a difference between the peripheral speeds, may not occur on the surfaces of the charging roller 1 and the photoconductor 2. According to the materials of the charging roller 1 and the photoconductor 2, or efficiency of the developing, transferring and cleaning processes, wearing flaws are not necessarily generated when there is a difference between the peripheral speeds. Furthermore, It is possible to rotate the charging roller 1 In the same direction as the rotation direction of the photoconductor 2 with the difference between the peripheral speeds. Alternatively, the charging roller 1 can be rotated in the opposite direction to the rotation direction of the photoconductor 2 even though the charging performance is sufficiently obtained.

Second Embodiment

Figure 3:
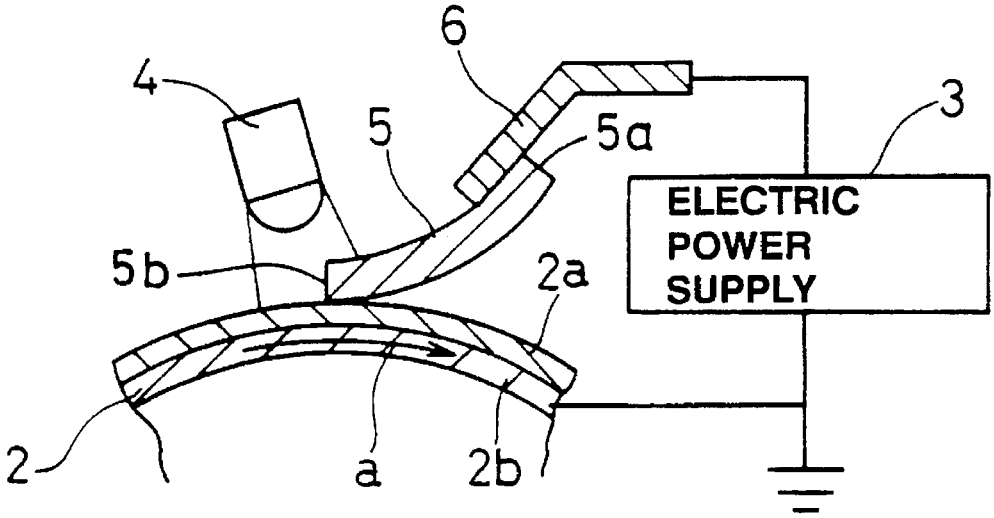
FIG. 3 is a sectional side view showing a configuration of a second preferred embodiment of an charging device of the invention.

A second preferred embodiment of the charging device of the invention is shown In FIG. 3. In the second embodiment, a charging blade 5 made of semiconductive material is used instead of the charging roller 1 in the first embodiment.

As shown in FIG. 3, the charging blade 5 has elasticity and is fixed on a holding member 6 in the vicinity of an end 5*a* thereof. The holding member 6 has conductivity. The other end 5*b* of the charging blade 5 contacts the surface of the photoconductive layer 2*a* of the photoconductor 2 with a predetermined pressure. A DC voltage is applied to the charging blade 5 from the electric power supply 3 through the holding member 6. The surface of the photoconductive layer 2*a* in the vicinity (before and behind) of a contacting point of the charging blade 5 and the photoconductor 2 can be divided into the three regions of closing region A, contacting region B and separating region C, similar to the first embodiment. In the closing region, the surface of the charging blade 5 is limited by the end 5*b* of the charging blade 5, so that the area of the surface of the charging blade 5 is very narrow. However, a discharging electric field is formed between the charging blade 5 and the photoconductive layer 2*a* of the photoconductor 2 in the closing region. Thus, it is necessary to expose the surfaces of the charging blade 5 and the photoconductive layer 2*a* in the closing region by the LED 4.

The charging blade 5 is made by a semiconductive rubber in which conductive particles such as carbon are dispersed in a rubber such as urethane or made by a semiconductive polymer sheet. Volume resistivity of the charging blade 5 is preferable $10^5$ to $10^{12}$ Ω cm. Furthermore, it is necessary to consider hardness, surface roughness or accuracy of the shapes of the charging blade 5, so as not to make a gap between the photoconductor 2 and the charging blade 5 for preventing leakage of the exposing light of the LED 4 from the closing region to the separating region through the gap. By such a configuration, the surface of the photoconductive layer 2*a* is evenly charged in the separating region, similar to the first embodiment.

Figure 4:
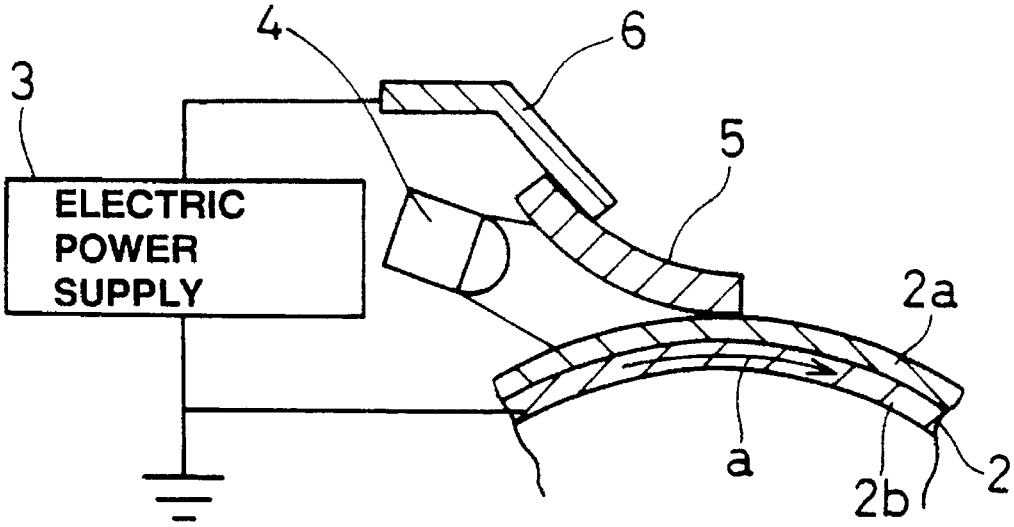
FIG. 4 is a sectional side view showing another configuration of the second embodiment of the charging device of the invention.

As shown in FIG. 3, the direction of the charging blade 5 to the rotation of the photoconductor 2 is the leading direction. However, It is possible to configure as shown in FIG. 4 that the direction of the charging blade 5 is in the trailing direction to the rotation of the photoconductor 2. By making the charging blade 5 contact the photoconductor 2, wearing force between the charging blade 5 and the photoconductor 2 becomes small, so that it is possible to prevent a stick-slip phenomenon (which causes uneven contact or noise by the small vibration of the charging blade 5) or wear of the photoconductive layer 2*a* of the photoconductor 2.

Third Embodiment

Figure 5:
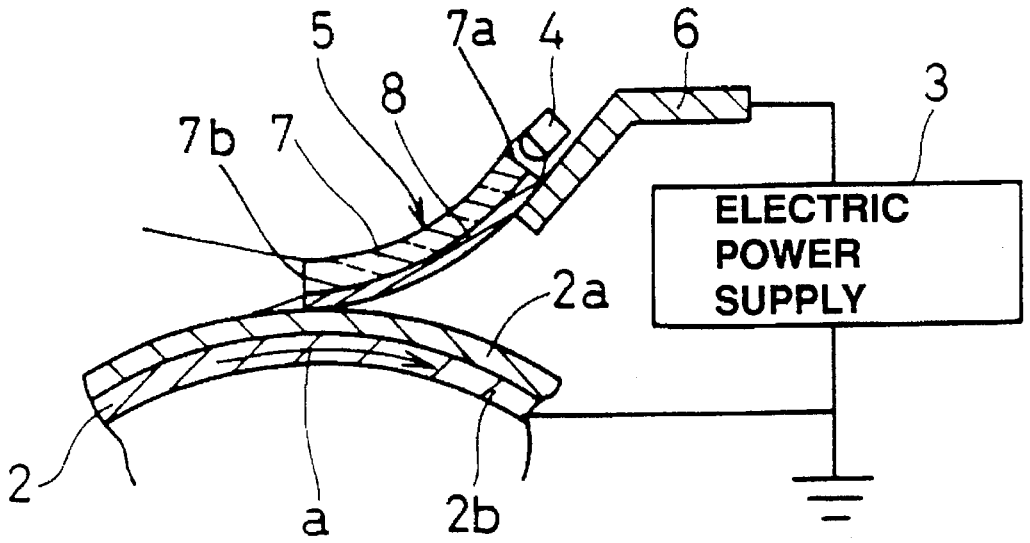
FIG. 5 is a sectional side view showing a configuration of a third preferred embodiment of a charging device of the invention.

A third preferred embodiment of the charging device of the invention is shown in FIG. 5. As shown in FIG. 5, the charging blade 5 comprises a transparent layer 7 and a shading layer 8. The charging blade 5 is fixed on the holding member 6 in the vicinity of an end 7*a* thereof. The LED 4 is disposed above the holding member 6 and in the vicinity of the end 7*a* of the charging blade 5. A light beam from the LED 4 enteres into the transparent layer 7 of the charging blade 5 from the end 7*a* in the sectional direction and output from the other end 7*b* for exposing the surfaces of the charging blade 5 and the photoconductive layer 2*a* of the photoconductor 2 in the closing region. The shading layer 8 prevents the leakage of the exposing light from the transparent layer 7 to the separating region. In the third embodiment, the transparent layer 7 of the charging blade 5 is made of a transparent urethane, silicon rubber or PET (polyethylene terephthalate) sheet. Therefore, the closing region can be exposed similar to the second embodiment, so that the surface of the photoconductive layer 2*a* can be charged evenly. In this embodiment, it is easy to adjust the position of the LED 4, since the LED 4 is disposed on the holding member 6 and the light beam of the LED 4 enters from the end 7*a* of the transparent layer 7 of the charging blade 5. Furthermore, the exposure can be concentrated only in the closing region, so that the light beam of the LED 4 can be used effectively.

The shading layer 8 serves as a discharging face for charging the separating region, so that the shading layer 8 can be made of resin including dispersed conductive carbon or tin oxide. In this case, the transparent layer 7 is not necessarily conductive. Alternatively, when the shading layer 8 is not conductive, a semiconductive layer (not shown in the figure) can be formed on the shading layer 8.

Fourth Embodiment

Figure 6:
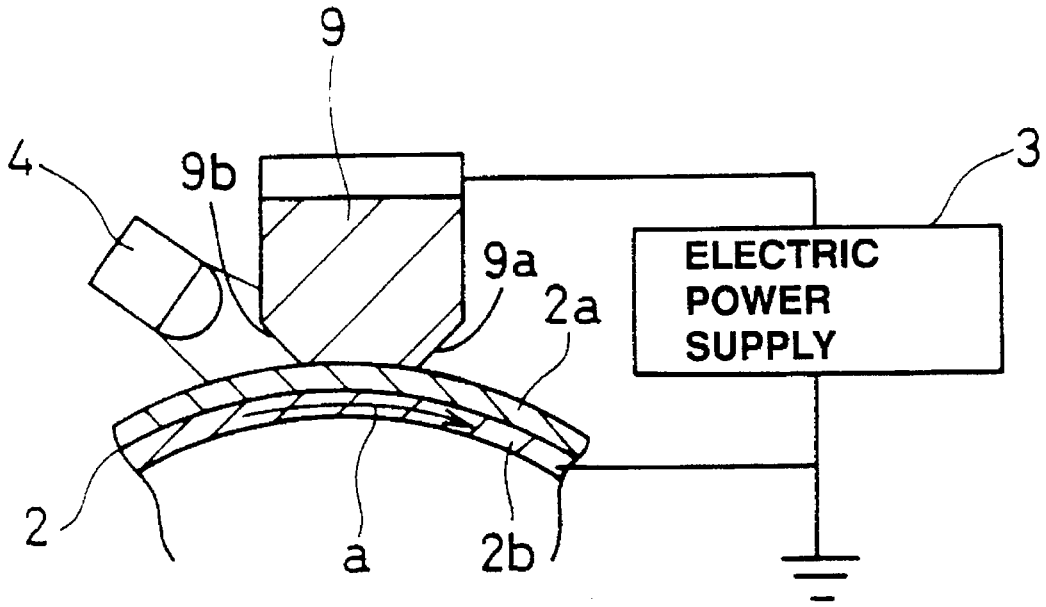
FIG. 6 is a sectional side view showing a configuration of a fourth preferred embodiment of an charging device of the invention.

A fourth preferred embodiment of the charging device of the invention is shown in FIG. 6. As shown in FIG. 6, a charging block 9 is used instead of the charging roller 1 or charging blade 5. The charging block 9 is made of semiconductive rubber. Both ends 9*a* and 9*b* of a contacting surface of the charging block 9 which is to contact the photoconductive layer 2*a* are chamfered, so that the distance between the surfaces of the charging block 9 and the photoconductive layer 2*a* in the closing region and the separating region can sufficiently be ensured. Since the area of the contacting surface of the charging blade 9 in the contacting region is wide, a friction force between the photoconductive layer 2*a* and the charging block 9 becomes larger. For reducing the friction force, a fluoro rubber or a silicon rubber can be used as a material of the charging block 9. Alternatively, a fluororesin can be coated on the contacting surface of the charging block 9. The surfaces of the charging block 9 and the photoconductive layer 2*a* in the closing region are exposed by the LED 4. The surface of the photoconductive layer 2*a* is charged by the discharge between the surfaces of the charging block 9 and the photoconductive layer 2*a* in the separating region. As a result, the photoconductive layer 2*a* is charged evenly.

Fifth Embodiment

Figure 7:
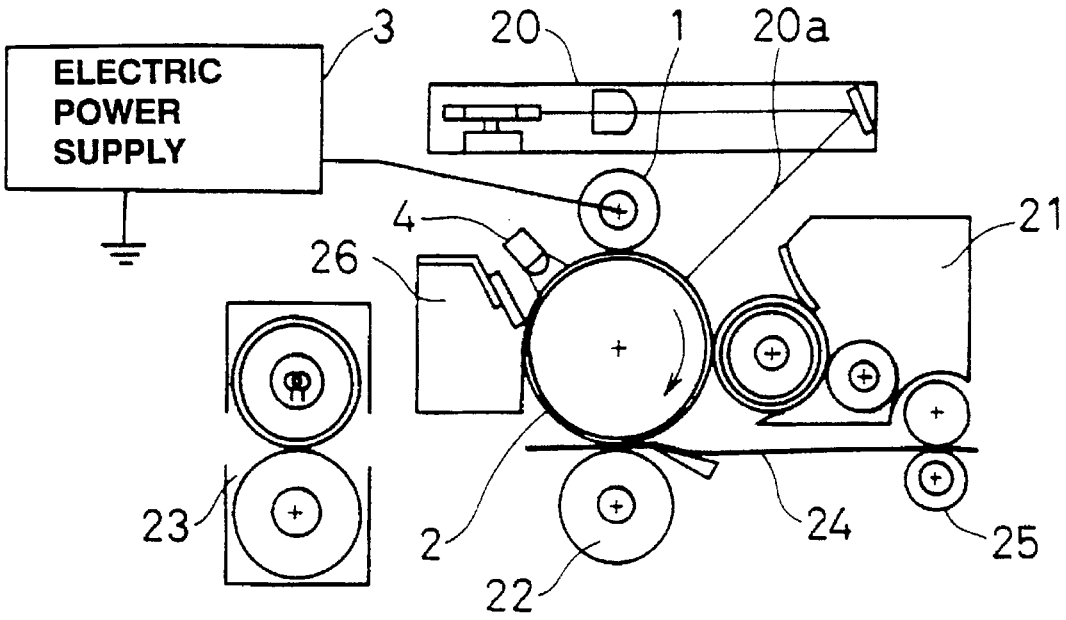
FIG. 7 is a sectional side view showing a configuration of an image forming apparatus using a fifth or a sixth preferred embodiment of a charging device of the invention.

A fifth preferred embodiment of the charging device of the invention and the image forming apparatus having the charging device are shown in FIG. 7. In comparison with the first embodiment shown in FIG. 2, the position of the LED 4 in the fifth embodiment is a little farther from the closing region of the charging roller 1 and the photoconductor 2 in the upstream side than that of the first embodiment. The other elements are substantially the same, so that the explanation of them is omitted.

The relation between the quantity of the light of the LED 4 and the surface potential of the photoconductive layer 2*a* was measured by using the image forming apparatus shown in FIG. 7. The potentiometer which was the same as that used in the first embodiment was used in the same position.

The experiment was executed under the lower temperature and the lower humidity environment. A DC voltage of −1100 V was applied to the charging roller 1 by the electric power supply 3. When the quantity of the light of the LED 4 was changed, it was observed that the surface potential of the photoconductive layer 2*a* was changed. Next, the conditions that the potential difference between surface potential of the photoconductive layer 2*a* when the surface of the photoconductive layer 2a was exposed by the LED 4 and surface potential of the photoconductive layer 2a when it was not exposed by the LED 4 was 0 V, 10 V, 20 V, 30 V, 40 V, and 50 V were obtained by changing the voltage applied to the LED 4. Furthermore, the actual picture images were printed under the conditions and quality of the printed picture images was evaluated. The evaluated result is shown in Table 1. In Table 1, a mark "○" designates that there was no fog, a mark "Δ" designates that there was a little fog and a mark "x" designate that there was a lot of fog.

TABLE 1

| Potential difference between the surface of the photoconductive layer 2a with exposure by LED 4 and without exposure | Evaluated result of the printed picture images |
|---|---|
| 0 V | Δ to x |
| 10 V | ○ to Δ |
| 20 V | ○ to Δ |
| 30 V | ○ |
| 40 V | ○ |
| 50 V | ○ |

From Table 1, it is found that fog may not occur when the potential difference between the surface potential of the photoconductive layer 2a with the exposure by the LED 4 and without the exposure is more than 30 V.

Figure 8:
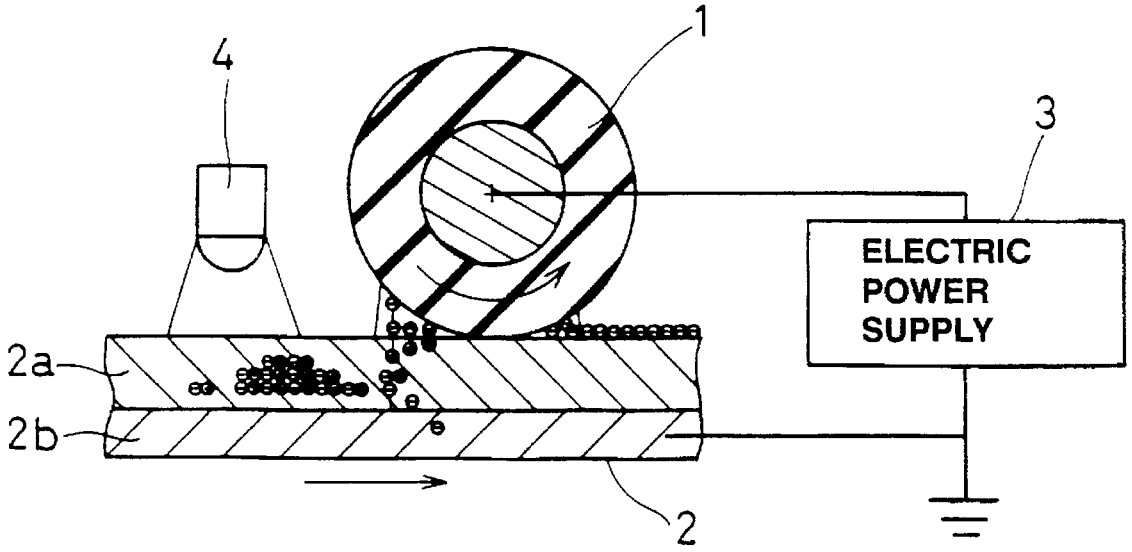
FIG. 8 is a sectional side view showing a principle of motion of the invention.

Such a phenomenon is considered with reference to FIG. 8. FIG. 8 shows the phenomenon in the photoconductive layer 2a by the exposure and the charging. When the photoconductive layer 2a is exposed by the LED 4, the pair carriers are generated in the photoconductive layer 2a by the photoconductivity thereof. The pair carriers exist after the exposure was finished, but they will self-quench without any treatment. For preventing the electrostatic charging of the photoconductive layer 2a in the closing region, it is necessary to put pair carriers in the photoconductive layer 2a in the vicinity of the closing region, which are sufficient to erase the electrostatic charge on the surface of the photoconductive layer 2a.

When the distance on the surface of the photoconductor 2 from a point where the light beam of the LED 4 was exposed and the contacting point of the charging roller 1 and the photoconductor 2 is defined as "L" and the peripheral velocity of the photoconductor 2 is defined as "$V_p$" mm/sec, the life of the pair carriers generated by the exposure of the LED 4 must be longer than $L/V_p$ sec.

A part of the pair carriers, which were sufficiently generated for erasing the electrostatic charge on the photoconductive layer 2a in the closing region, remains even when the exposed part of the photoconductive layer 2a reaches to the separating region. Thus, the remaining pair carriers reduces the surface potential of the photoconductive layer 2a in the separating region. From Table 1, it is found that the best condition is obtained when the amount of the remaining pair carriers is sufficient to reduce the surface potential of the photoconductive layer 2a in the separating region over 30 V. Thus, when the reduction of the surface potential of the photoconductive layer 2a is over 30 V, the charge on the surface of the photoconductive layer 2a in the closing region is sufficiently cancelled and the over charge on the photoconductive layer 2a in the separating region can be prevented. On the other hand, when the amount of the pair carriers in the photoconductive layer 2a is not sufficient, it can reduce the surface potential of the photoconductive layer 2a only about 20 V, and cancelling of the charge on the surface of the photoconductive layer 2a in the closing region is not sufficient. Thus, unevenness in charge distribution on the surface of the photoconductive layer 2a will occur in the separating region.

For satisfying the condition to obtain the potential difference over 30 V between the surface potential of the photoconductive layer 2a when it is exposed by the LED 4 and the surface potential of the photoconductive layer 2a when it is not exposed, the quantity of the light of the LED 4 can be controlled not only by adjusting the power of the LED 4 but also by changing the position of the LED 4 or by changing the distance between the exposing point and the contacting point.

By the above-mentioned configuration, the charging of the surface of the photoconductive layer 2a in the closing region can be prevented and the photoconductive layer 2a is charged only in the separating region, so that the photoconductive layer 2a can be charged evenly.

In the above-mentioned fifth embodiment, a monolayer-type photoconductive layer 2a is used. However, a multilayer-type photoconductive layer, which has a charge generating layer for generating the electric charge and a charge transfer layer in which the electric charge moves, can be used. The operation in the latter case is substantially the same as those in the former case. Furthermore, regarding the order of lamination on the conductive base layer 2b in the latter case, it is preferable that the charge generating layer is on the charge transfer layer, or alternatively, the charge transfer layer is on the charge generating layer.

Furthermore, as a charging means, the charging roller 1 is used. Alternatively, non-rotative cylinder, blade or block can be used for obtaining the similar effects.

Sixth Embodiment

In a preferred sixth embodiment of the charging device of the invention and the image forming apparatus having the charging device is described. In the sixth embodiment, the quantity of the exposure light of the LED 4 was changed and the picture image printed by the apparatus shown in FIG. 7 was estimated similar to the above-mentioned fifth embodiment. In this embodiment, a difference between a current flowing into the charging roller 1 when the surface of the photoconductive layer 2a was exposed by the LED 4 and a current flowing into the charging roller 1 when the surface of the photoconductive layer 2a was not exposed was considered. Picture images were printed under the conditions that the difference of the currents were changed by 1 μA from 0 μA to 8 μA by changing the power of the LED 4. The results of the evaluation of the picture images are shown in Table 2. The marks in Table 2 designate the same as in Table 1.

TABLE 2

| Difference between the currents flowing into the charging roller 1 when the surface of the photoconductive layer 2a was exposed and not exposed by the LED 4 | Evaluated result of the printed picture images |
|---|---|
| 0 μA | x |
| 1 μA | Δ |
| 2 μA | Δ |
| 3 μA | Δ |
| 4 μA | ○ to Δ |
| 5 μA | ○ to Δ |
| 6 μA | ○ |
| 7 μA | ○ |
| 8 μA | ○ |

From Table 2, it is found that when the difference between the currents flowing into the charging roller 1 when the surface of the photoconductive layer 2a was exposed and not exposed by the LED 4 was over 5 μA, fog was not generated. Similar to the above-mentioned fifth embodiment, the pair carriers had cancelled the electrostatic charge on the surface of the photoconductive layer 2a in the closing region. Thus, the charge on the surface of the photoconductive layer 2a in the closing region disappeared. From the point of charging the current flowing into the charging roller 1, the current which did not contribute to the charging operation for charging the surface of the photoconductive layer 2a in the closing region, so that the current flowing into the charging roller 1 when the surface of the photoconductive layer 2a was exposed by the light beam of the LED 4 became larger than the current when the surface of the photoconductive layer 2a was not exposed. It is considered that the pair carriers can exist sufficiently in the photoconductive layer 2a in the closing region when the increased current is over 5 μA, so that the charging of the surface of the photoconductive layer 2a in the closing region can be restricted. After that, the surface of the photoconductive layer 2a can be charged evenly in the separating region.

In the above-mentioned first to sixth embodiments, the LED is used as an element for exposing the surfaces of the charging roller 1 and the surface of the photoconductive layer 2a in the closing region. However, it is not limited to the LED, another light source outputting a light beam of a predetermined wavelength of the sensitivity of the photoconductive layer 2a, such as a cold cathode ray tube, a glow lamp, a halogen lamp, semiconductor laser can be used with consideration of cost, configuration and/or printing speed of the apparatus.

Furthermore, the material of the photoconductive layer 2a is not limited to an organic photoconductor. Other photoconductive materials such as selenium, amorphous silicon can be used.

Seventh Embodiment

Figure 9:
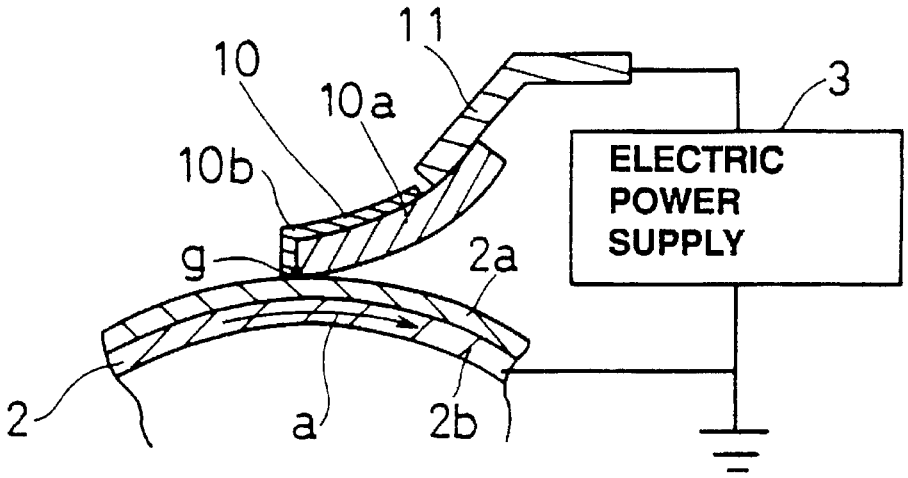
FIG. 9 is a sectional side view showing a configuration of a seventh preferred embodiment of an charging device of the Invention.

A seventh preferred embodiment of the charging device of the invention, which have a discharging restriction member, is shown in FIG. 9. As shown in FIG. 9, a charging blade 10 comprises a conductive member 10a and a discharging restriction member 10b which covers an upstream part of the surface of the conductive member 10a from the contacting point of the conductive member 10a and the surface of the photoconductive layer 2a of the photoconductor 2. The charging blade 10 is held by a holding member 11. Thus the charging blade 10 is disposed at a predetermined position.

In this embodiment, as a material of the conductive member 10a of the charging blade 10, polyurethane with dispersed carbon particles which has volume resistivity of $10^8$ Ω cm is used. As a material of the discharging restriction member 10b, PET (polyethylene terephthalate) was used. The discharging restriction member 10b is integrally adhered to the top end of the conductive member 10a. Furthermore, the boundary g of the conductive member 10a and the discharging restriction member 10b in a plane facing to the surface of the photoconductive layer 2a is positioned at the contacting point of the charging blade 10 and the photoconductive layer 2a.

Figure 10:
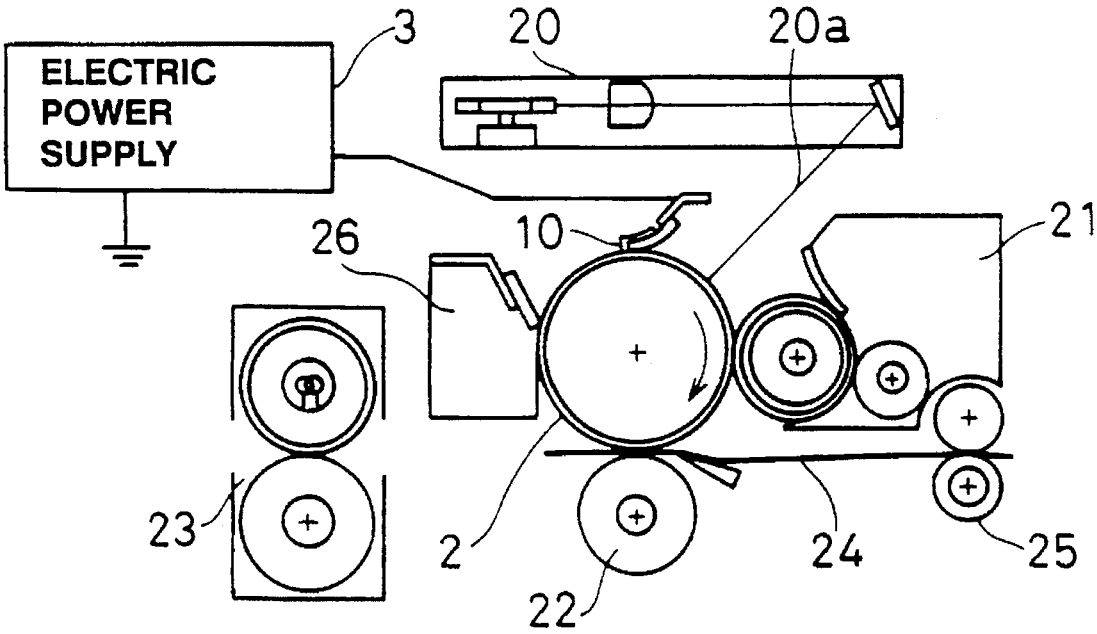
FIG. 10 is a sectional side view showing a configuration of an image forming apparatus having the charging device of FIG. 9.

An image forming apparatus having the above-mentioned charging device shown in FIG. 9 is shown in FIG. 10. In comparison with the first embodiment shown in FIG. 2, all the elements except the charging device are substantially the same, so that the configuration of the apparatus, the explanation of the other elements and the operation are omitted.

Picture images were printed by the image forming apparatus shown in FIG. 10 under lower temperature and lower humidity conditions. The printed picture images were estimated. As a result, good quality picture images without any fog or white holes caused by unevenness of the charge distribution on the surface of the photoconductive layer 2a could be obtained. The discharging between the charging blade 10 and the photoconductive layer 2a in the closing region was restricted by the discharging restriction member 10b, and the surface of the photoconductive layer 2a was charged only in the separating region.

It is preferable that the volume resistivity of the conductive member 10a is from $10^5$ to $10^{12}$ Ω cm. On the other hand, it is preferable that the resistance of the discharging restriction member 10b is sufficiently larger than that of the conductive member 10a and the volume resistivity of the discharging restriction member 10b is from $10^{10}$ to $10^{15}$ Ω cm.

The boundary g between the conductive member 10a and the discharging restriction member 10b can be positioned in the contacting region or in the separating region of the charging blade 10 and the photoconductive layer 2a. When the boundary g is positioned in the separating region, it is necessary to make a gap between the charging blade 10 and the surface of the photoconductive layer 2a at the boundary g smaller (than 50 μm following the experimental result in the first embodiment) for preventing abnormal discharging at a position where the gap is relatively large.

Eighth Embodiment

Figure 11:
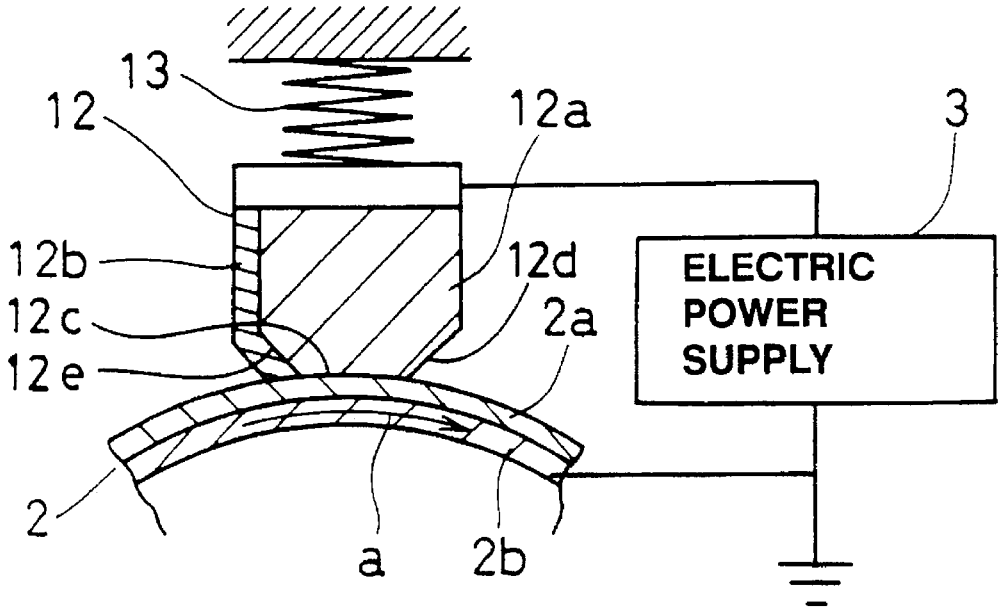
FIG. 11 is a sectional side view showing a configuration of an eighth preferred embodiment of an charging device of the invention.

An eighth preferred embodiment of the charging device of the invention is shown in FIG. 11. As shown in FIG. 11, a charging block 12 is used as a charging means in this embodiment. The charging block 12 comprises a conductive member 12a and a discharging restriction member 12b. The materials are substantially the same as those in the seventh embodiment.

The conductive member 12a is processed to make a surface 12c uniformly contact the surface of the photoconductive layer 2a of the photoconductor 2. A compression spring 13 is provided above the charging block 12 for supplying a predetermined pressure to the charging block 12. Thus, the charging block 12 contacts the surface of the photoconductive layer 2a with the predetermined pressure. Both ends 12d and 12e of a contacting surface of the charging block 12 which is to contact the photoconductive layer 2a of the photoconductor 2 are chamfered, so that the distance between the surfaces of the charging block 12 and the photoconductive layer 2a in the closing region and the separating region are sufficiently ensured. The discharge restriction member 12b is adhered to the conductive member 12a in the upstream part of the contacting region.

Picture images were printed under the same conditions as the above-mentioned fifth embodiment. The printed picture images were estimated. As a result, good quality picture images without any fog or white holes caused by unevenness of the charge distribution could be obtained.

Ninth Embodiment

Figure 12:
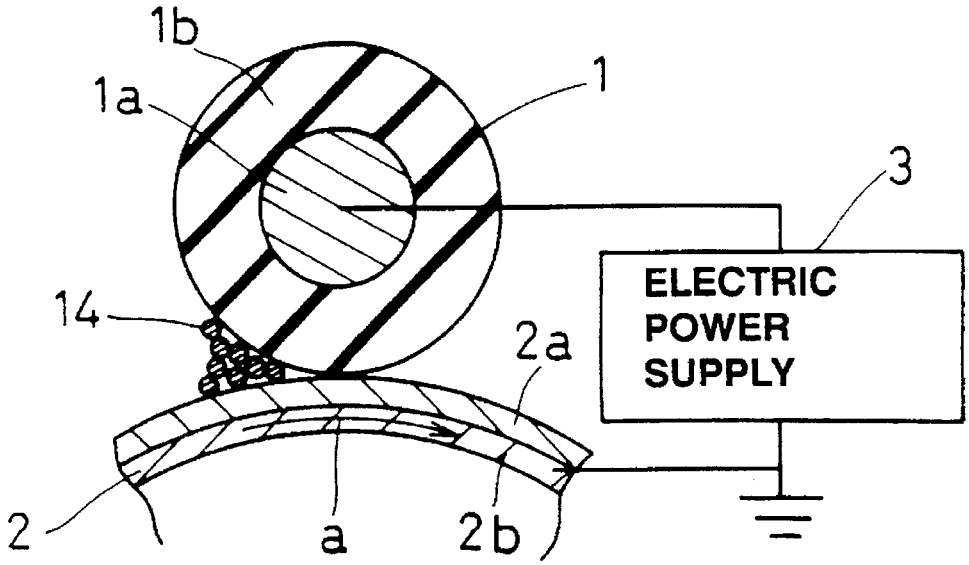
FIG. 12 is a sectional side view showing a configuration of a ninth preferred embodiment of a charging device of the invention.

A ninth preferred embodiment of the charging device of the invention Is shown In FIG. 12. As shown in FIG. 12, insulation particles 14 are used as a discharging restriction member. The charging roller (or cylinder) 1 is not rotative. The insulation particles are damed out in the upstream part from the contacting point of the charging roller 1 and the photoconductive layer 2a of the photoconductor 2. Thus, the discharge between the charging roller 1 and the photoconductive layer 2a in the upstream part of the contacting point, namely in the closing region, can be restricted. The configuration and the materials of the charging roller 1 are substantially the same as the above-mentioned third embodiment.

In this embodiment, magnetic toner having a diameter of 12 μm is used as the insulation particles 14.

Picture images were printed under the same condition of the above-mentioned seventh or eighth embodiment. The printed picture images were estimated. As a result, good quality picture images without any fog or white holes caused by unevenness of the charge distribution could be obtained.

The insulation particles serving as discharging restriction member is not limited by the magnetic toner. However, it is desirable that the particles are to be spherical so as not to scratch the surfaces of the photoconductive layer 2 and the charging roller 1. The diameter of the insulation particles 14 is desirably smaller than 20 μm, especially to be 8 to 15 μm. Since the diameter of the insulation particles 14 is satisfied the condition, the insulation particles 14 can be come in the deep part where the gap between the surfaces of the charging roller 1 and the photoconductor 2 is very small, and the insulation particles 14 may not fly into the separating region over the contacting region of the charging roller 1 and the photoconductive layer 2*a* of the photoconductor 2.

Tenth Embodiment

Figure 13:
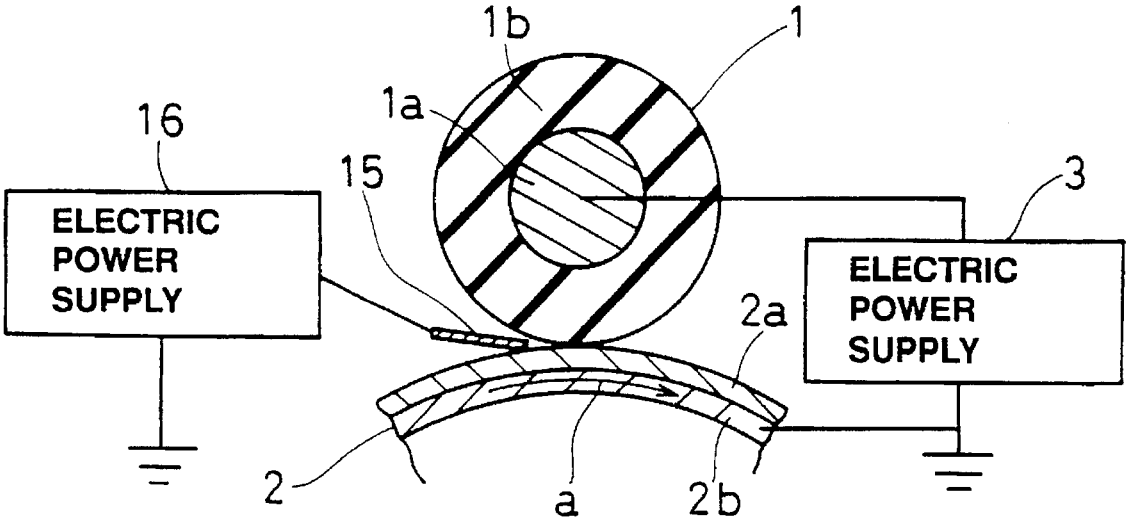
FIG. 13 is a sectional side view showing a configuration of a tenth preferred embodiment of a charging device of the invention.
Figure 14:
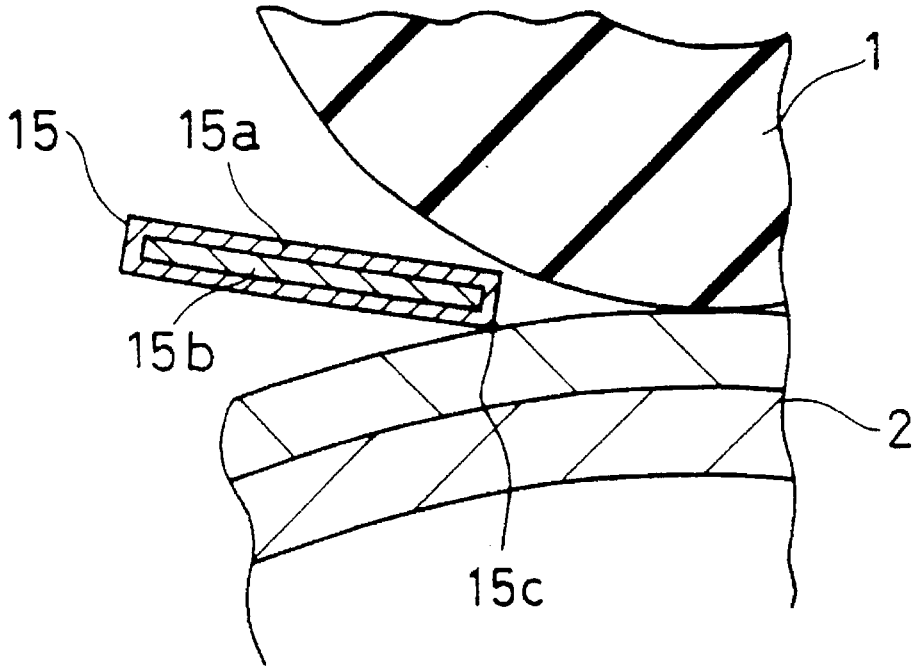
FIG. 14(*a*) is a partially enlarged sectional side view showing a detailed configuration of the charging device of FIG. 13.
Figure 14:
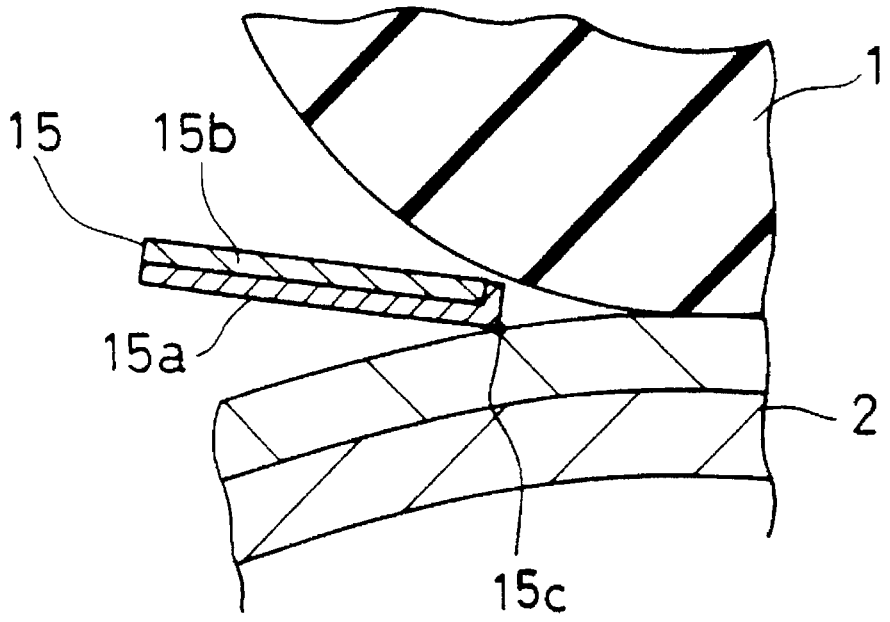

A tenth preferred embodiment of the charging device of the invention is shown in FIGS. 13, 14(*a*) and 14(*b*). As shown in FIG. 13, a conductive blade 15 is used as a charging restriction member in the closing region. A voltage is applied to the conductive blade 15 by an electric power supply 16.

As shown in FIG. 14(*a*) or 14(*b*), the conductive blade 15 has a multiple layer configuration. The internal or upper part 15*b* of the conductive blade 15 is a conductive elastic member and the external or lower part 15*a* of the conductive blade 15 is a resistive layer. The conductive elastic member 15*a* is formed by dispersing conductive particles such as carbon into a rubber material such as urethane rubber. The surface of the conductive elastic member 15*a* is coated by the resistive layer 15*b* for preventing the leakage of the electric charge to the pin holes existing on the surface of the the photoconductive layer 2*a* of the photoconductor 2. Volume resistivity of the resistive layer 15*b* is preferably $10^5$ to $10^{12}$ Ω cm.

The conductive blade 15 is disposed in the vicinity of the charging roller 1 and the photoconductor 2 in the closing region. In detail, an edge 15*c* of the conductive blade 15 is provided parallel to the axis of the photoconductor 2 and to contact the surface of the photoconductive layer 2*a* of the photoconductor 2. Thereby, a minute gap between the conductive blade 15 and the charging roller 1 can be maintained stably.

The absolute value of the voltage applied to the conductive blade 15 is selected to be smaller than that of the charging roller 1. Furthermore, the voltage may not be cause of the discharge between the conductive blade 15 and the photoconductive layer of the photoconductor 2. The latter condition can be controlled by measuring the surface of the photoconductive layer 2*a* of the photoconductor 2 with applying the voltage only to the conductive blade 15 and without applying any voltage to the charging roller 1. In the latter condition that the discharge may not occur is satisfied, the conductive blade 15 can be grounded instead of applying the voltage. Under this condition, the discharging from the conductive blade 15 to the photoconductive layer 2*a* may not occur. On the other hand, the discharge from the charging roller 1 to the photoconductive layer 2*a* in the closing region can be prevented by the conductive blade 15. Therefore, the charging of the photosensitive layer 2*a* of the photoconductor 2 in the closing region is restricted, so that unevenness of charge distribution on the surface of the photoconductive layer 2*a* caused by abnormal discharge can be prevented. The widths of the charging roller 1 and the conductive blade 15 in a direction parallel to the axis of the photoconductor 2 are wider than the width of a part of the surface of the photoconductive layer 2*a* which is used for forming the picture images.

In the above-mentioned tenth embodiment, the conductive blade 15 directly contacts the surface of the photoconductive layer 2*a* of the photoconductor 2. However, substantially the same effects can be obtained when the conductive blade 15 is a little separted from the surface of the photoconductive layer 2*a* of the photoconductor 2. In the latter case, the conductive blade 15 is held with a predetermined gap by a spacer inserted between the conductive blade 15 and the surface of the photoconductive layer 2*a* of the photoconductor 2.

Figure 15:
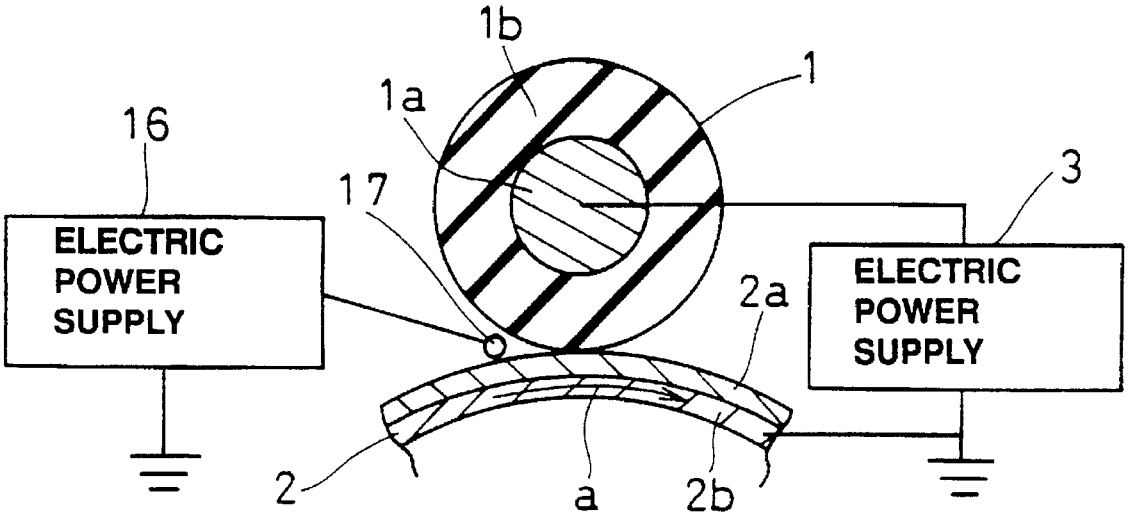
FIG. 15 is a sectional side view showing another configuration of the tenth embodiment of the charging device of the invention.
Figure 16:
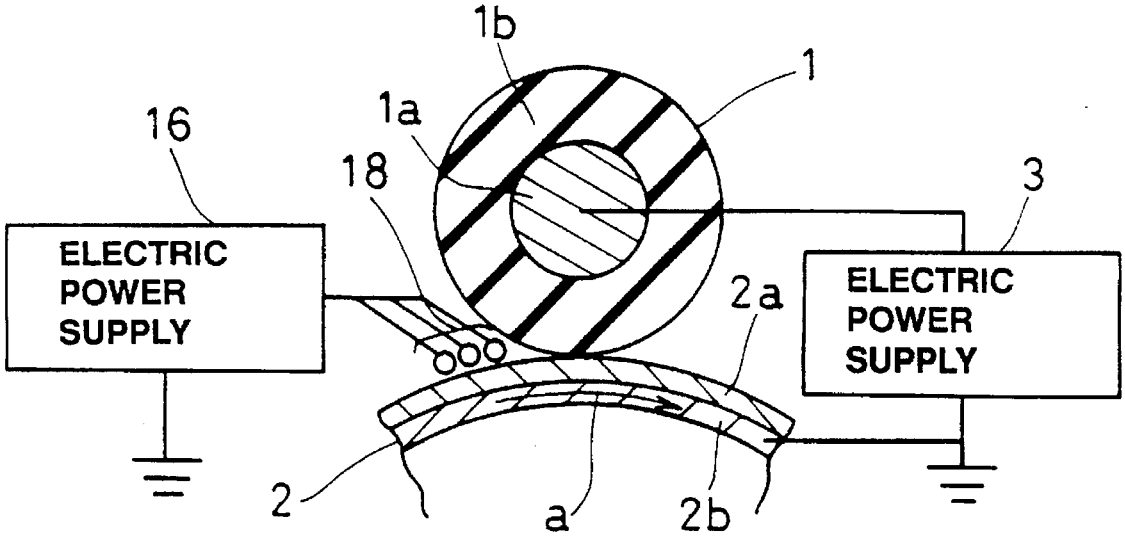
FIG. 16 is a sectional side view showing still another configuration of the tenth embodiment of the charging device of the invention.

Furthermore, the shape of the charging restriction member is not limited by the blade shape. A wire 17 having a restrictive layer on the surface thereof shown in FIG. 15 can be used, so that substantially the same effect can be obtained. In case of using the wire, when a plurality of wires 18 is used as shown in FIG. 16, the charge restriction effect in the closing region can be increased, so that the unevenness of the charge distribution caused by the abnormal discharging can be reduced much smaller.

The materials of the charging elements such as charging roller 1, charging blade 5 and the like in the first to tenth embodiments are not limited by the description in the embodiments. A material having a appropriate resistance and being not scratched or worn by contacting the photoconductor 2 can be used. Furthermore, the shape of the charging elements are not limited by the roller, blade, block or the like. Another shape, by which the closing region, the contacting region and the separating region are formed on between the charging element and the photoconductor, is acceptable. Furthermore, as a voltage applied to the charging element, not only the DC voltage used in the embodiments but also a superposed voltage of AC and DC voltages can be used. In the latter case, discharge breakdown of the photoconductive material can be prevented.

Furthermore, with respect to the seventh to tenth embodiments, the object to be charged is not the photoconductive material. These embodiments can be applied to another object to be charged.

The invention may be embodied in other specific forms without separating from the spirit and scope thereof. The embodiments are to be considered in all respects as illustrative and not restrictive. The scope of the invention is indicated by the appended claims rather than by the foregoing description, and all changes which come within the meaning and range of equivalency of the claims are intended to be embraced therein.

What is claimed is:

1. A charging device for charging a moving object comprising:

a charging member which contacts said object in a contacting region and charges the object in a separating region disposed in a downstream part from said contacting region in the moving direction of said object where surfaces of said charging member and said object move away from each other;

an electric power supply for applying a voltage to the charging member; and a discharging restriction means for restricting the discharging between said charging member and said object in a closing region disposed in an upstream part from said contacting region where surfaces of said charging member and said object move closer to each other; wherein said discharging restriction means comprises insulation particles provided in said closing region.

2. The charging device in accordance with claim 1, wherein said insulation particle is a magnetic toner having a spherical shape and a diameter of 8 to 15 μm.

3. An image forming apparatus comprising:

an object to be charged and moving a predetermined moving direction;

a charging member which contacts said object in a contacting region and charges the object in a separating region disposed in a downstream part from said contacting region in the moving direction of said object where surfaces of said charging member and said object move away from each other;

an electric power supply for applying a voltage to the charging member; and a discharging restriction means for restricting the discharging between said charging member and said object in a closing region disposed in an upstream part from said contacting region where surfaces of said charging member and said object move closer to each other; wherein said discharging restriction means is an insulation layer formed on a part of surface of said charging member facing said object in said closing region.

4. A charging device for charging a moving object comprising:

a charging member which contacts said object in a contacting region and charges the object in a separating region disposed in a downstream part from said contacting region in the moving direction of said object where surfaces of said charging member and said object move away from each other;

an electric power supply for applying a voltage to the charging member; and a discharging restriction means for restricting the discharging between said charging member and said object in a closing region disposed in an upstream part from said contacting region where surfaces of said charging member and said object move closer to each other; wherein said discharging restriction means comprises an insulation layer formed on a part of surface of said charging member facing said object in said closing region.

5. The charging device in accordance with claim 4, wherein said charging member comprises a blade and said insulation layer is provided near an end of said blade contacting said object.

6. The charging device in accordance with claim 4, wherein said charging member has a volume resistivity of $10^5$ to $10^{12}$ Ω cm; and said insulation layer has a volume resistivity of $10^{10}$ to $10^{15}$ Ω cm.

7. The charging device in accordance with claim 4, wherein a boundary between said charging member and said insulation layer is in said contacting region.

8. The charging device in accordance with claim 4, wherein said charging member comprises a block and said insulation layer is provided near an end of said block contacting said object.

9. A charging device for charging a moving object comprising:

a charging member which contacts said object in a contacting region and charges said object in a separating region disposed in a downstream part from said contacting region in the moving direction of said object where surfaces of said charging member and said object move away from each other;

an electric power supply for applying a voltage to said charging member; and a charging restriction means for restricting the charging of said object in a closing region disposed in an upstream part from said contacting region where surfaces of said charging member and said object move closer to each other; wherein said charging restriction means is a light exposing device for exposing at least said surfaces of said charging member and said object in said closing region, said charging member is a blade comprising a transparent layer for guiding light beam from said light exposing device to said closing region and a shading layer for shading said light beam to said contacting region and said separating region; and said light exposing device is disposed in the vicinity of an end of said transparent layer opposite to the other end in said closing region in a section parallel to said moving direction of said object.

10. The charging device in accordance with claim 9, wherein said electric power supply supplies DC voltage to said charging member.

11. The charging device in accordance with claim 9, wherein said charging member is a blade having elasticity and semiconductivity.

12. The charging device in accordance with claim 11, wherein said blade is made of semiconductive rubber including conductive particles.

13. The charging device in accordance with claim 12, wherein said rubber is selected from the group consisting of urethane, ethylene propylene diene monomer and silicon.

14. The charging device in accordance with claim 12, wherein said conductive particles are carbon or inorganic metalic salt.

15. The charging device in accordance with claim 11, wherein said blade is made of a semiconductive polymer sheet.

16. The charging device in accordance with claim 11, wherein said blade has a volume resistivity of $10^5$ to $10^{12}$ Ω cm.

17. The charging device in accordance with claim 9, wherein said charging restriction means is disposed in a part upstream from said closing region; and quantity of the light emitted from said light exposing device is controlled in a manner so that a potential difference between surface potential of said object when it is exposed and surface potential of said object when it is not exposed is more than 30 V.

18. The charging device in accordance with claim 9, wherein said charging restriction means is disposed in a part upstream from said closing region; and quantity of the light emitted from said light exposing device is controlled in a manner so that a difference between a current flowing into said charging member when a surface of said object is exposed and a current flowing into said charging member when said surface of said object is not exposed is more than 5 μA.

19. The charging device in accordance with claim 17 or 18, wherein said light exposing device is one selected from the group consisting of a light emitting diode, cold cathode ray tube, a glow lamp, a halogen lamp and a semiconductor laser.

20. The charging device in accordance with claim 9, wherein said object to be charged is a photoconductive material selected from the group consisting of selenium, amorphous silicon and organic photoconductive material.

21. The charging device in accordance with claim 9, wherein said charging restriction means is a conductive member provided in said closing region, to which a predetermined voltage is applied.

22. The charging device in accordance with claim 21, wherein said conductive member comprises a blade.

23. The charging device in accordance with claim 21, wherein a resistive layer is formed on at least a part of a surface of said conductive member facing to said object.

24. The charging device in accordance with claim 23, wherein said resistive layer has a volume resistivity of $10^5$ to $10^{12}$ Ω cm.

25. The charging device in accordance with claim 21, wherein said conductive member comprises at least one wire.

26. The charging device in accordance with claim 9, wherein said charging restriction means is a conductive member provided in said closing region, said conductive member being grounded.

27. The charging device in accordance with claim 26, wherein said conductive member comprises a blade.

28. The charging device in accordance with claim 26, wherein said conductive member comprises at least one wire.

29. The charging device in accordance with claim 26, wherein a resistive layer is formed on at least a part of a surface of said conductive member facing to said object.

30. The charging device in accordance with claim 29, wherein said resistive layer has a volume resistivity of $10^5$ to $10^{12}$ Ω cm.

31. An image forming apparatus comprising:

an object to be charged and moving a predetermined moving direction;

a charging member which contacts said object in a contacting region and charges the object in a separating region disposed in a downstream part from said contacting region in the moving direction of said object where surfaces of said charging member and said object move away from each other;

an electric power supply for applying a voltage to the charging member; and a charging restriction means for restricting the charging of said object in a closing region disposed in an upstream part from said contacting region where surfaces of said charging member and said object move closer to each other; wherein said charging restriction means is a light exposing device for exposing at least said surfaces of said charging member and said object in said closing region, said charging member is a blade comprising a transparent layer for guiding light beam from said light exposing device to said closing region and a shading layer for shading said light beam to said contacting region and said separating region, and said light exposing device is disposed in the vicinity of an end of said transparent layer opposite to the other end in said closing region in a section parallel to said moving direction of said object.

32. The image forming apparatus in accordance with claim 31, wherein said charging restriction means is disposed in a part upstream from said closing region; and quantity of the light emitted from said light exposing device is controlled in a manner so that a potential difference between surface potential of said object when it is exposed and surface potential of said object when it is not exposed is more than 30 V.

33. The image forming apparatus in accordance with claim 31, wherein said charging restriction means is disposed in a part upstream from said closing region; and quantity of the light emitted from said light exposing device is controlled in a manner so that a difference between a current flowing into said charging member when a surface of said object is exposed and a current flowing into said charging member when said surface of said object is not exposed is more than 5 μA.

34. The image forming apparatus in accordance with claim 31, wherein said charging restriction means is a conductive member provided in said closing region, to which a predetermined voltage is applied.

35. The image forming apparatus in accordance with claim 31, wherein said charging restriction means is a conductive member provided in said closing region, said conductive member being grounded.

* * * * *